US008113002B2

(12) United States Patent
Lacy et al.

(10) Patent No.: US 8,113,002 B2
(45) Date of Patent: Feb. 14, 2012

(54) COMBUSTOR BURNER VANELETS

(75) Inventors: Benjamin Lacy, Greer, SC (US); Balachandar Varatharajan, Loveland, OH (US); Gilbert Otto Kraemer, Greer, SC (US); Ertan Yilmaz, Albany, NY (US); Baifang Zuo, Simpsonville, SC (US)

(73) Assignee: General Electric Company, Schenetady, NY (US)

( * ) Notice: Subject to any disclaimer, the term of this patent is extended or adjusted under 35 U.S.C. 154(b) by 789 days.

(21) Appl. No.: 12/253,268

(22) Filed: Oct. 17, 2008

(65) Prior Publication Data

US 2010/0095675 A1 Apr. 22, 2010

(51) Int. Cl.
*F02C 1/00* (2006.01)

(52) U.S. Cl. ..... 60/748; 60/737; 60/776

(58) Field of Classification Search ..... 60/748, 60/737, 740, 776; 431/8, 9, 181, 278, 284, 431/285

See application file for complete search history.

(56) References Cited

U.S. PATENT DOCUMENTS

| | | | | |
|---|---|---|---|---|
| 6,279,322 | B1 * | 8/2001 | Moussa | 60/751 |
| 6,993,916 | B2 | 2/2006 | Johnson et al. | |
| 2007/0234735 | A1 | 10/2007 | Mosbacher et al. | |
| 2008/0078183 | A1 | 4/2008 | Ziminsky et al. | |

* cited by examiner

*Primary Examiner* — Ehud Gartenberg
*Assistant Examiner* — Vikansha Dwivedi
(74) *Attorney, Agent, or Firm* — Sutherland Asbill & Brennan LLP

(57) ABSTRACT

The present application provides a burner for use with a combustor of a gas turbine engine. The burner may include a center hub, a shroud, a pair of fuel vanes extending from the center hub to the shroud, and a vanelet extending from the center hub and/or the shroud and positioned between the pair of fuel vanes.

20 Claims, 4 Drawing Sheets

COMBUSTOR BURNER VANELETS

STATEMENT REGARDING FEDERALLY SPONSORED RESEARCH AND DEVELOPMENT

This invention has been made with government support under Contract No. DE-FC26-05NT42643 awarded by the U.S. Department of Energy. The Government has certain rights in the invention.

TECHNICAL FIELD

The present application relates generally to gas turbine engines and more particularly relates to a combustor burner with vanelets positioned between the fuel vanes.

BACKGROUND OF THE INVENTION

Various types of combustors are known and used in gas turbine engines. In turn, these combustors generally use different types of fuel burners or nozzles depending upon the type of fuel in use. For example, most natural gas fired systems operate using lean premixed flames. In these systems, fuel is mixed with air upstream of the reaction zone to create a premixed flame. One example is a "swozzle" (swirler+nozzle) in which the fuel ports are positioned about a number of extending vanes so as to inject the fuel into the air stream. Alternatively in systems using syngas or other types of fuels, diffusion nozzles may be used to inject the fuel and the air directly into the combustion chamber due to the generally higher reactivity of the fuel.

Current combustor designs, however, focus on fuel flexibility with respect to the use of natural gas and other types of fuels. As a result, operational issues may arise when switching from one type of fuel to another while using the same components. For example, syngas may have a much higher volumetric flow rate as opposed to natural gas due to its lower Modified Wobbe Index. As a result of this and the high reactivity of some of these fuels, flame holding issues may arise. The design of the combustor and its components thus should accommodate these varying fuel characteristics such as different fuel reactivities, fuel temperatures, heating values, molecular weight, etc.

There is thus a desire for improved combustor components in general and an improved burner in specific. Such a burner may provide for good fuel and air mixing for greater fuel flexibility while maintaining system efficiency and limiting overall emissions. Such fuel flexible systems should accommodate natural gas and other types of fuels without expensive equipment changeovers.

SUMMARY OF THE INVENTION

The present application thus provides a burner for use with a combustor of a gas turbine engine. The burner may include a center hub, a shroud, a pair of fuel vanes extending from the center hub to the shroud, and a vanelet extending from the center hub and/or the shroud and positioned between the pair of fuel vanes.

The present application further provides a method of mixing fuel and air in a combustor burner of a gas turbine. The method includes the steps of flowing the air into a swozzle assembly, flowing the fuel through a number of fuel vanes in the swozzle assembly, imparting swirl to the flow of air and the flow of fuel to create a premixed flow, and positioning a vanelet between a pair of the of the fuel vanes so as to at least maintain the premixed flow at a predetermined velocity as the premixed flow leaves the fuel nozzles.

The present application further provides for a swozzle assembly for use with a combustor of a gas turbine engine. The swozzle assembly may include a center hub, a shroud, a number of swozzle vanes extending from the center hub to the shroud, and a number of vanelets extending from the center hub and/or the shroud and with one of the vanelets positioned between each pair of the swozzle vanes.

These and other features of the present patent application will become apparent to one of ordinary skill in the art upon review of the following detailed description when taken in conjunction with the several drawings and the appended claims.

DETAILED DESCRIPTION OF THE INVENTION

Figure 1:
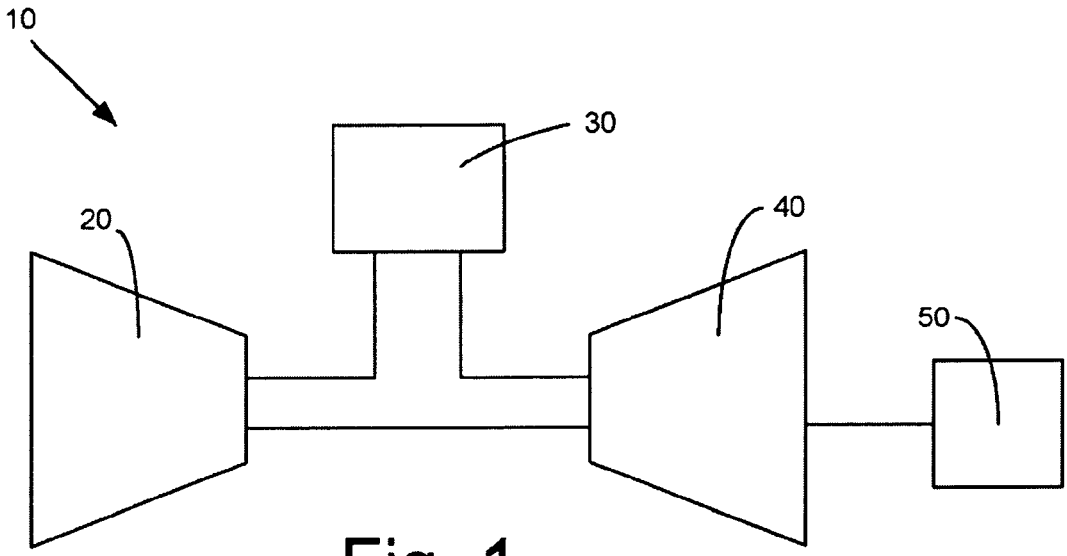
FIG. 1 is a schematic view of a gas turbine engine.

Referring now to the drawings, in which like numbers refer to like elements throughout the several views, FIG. 1 shows a schematic view of a gas turbine engine 10. As is known, the gas turbine engine 10 may include a compressor 20 to compress an incoming flow of air. The compressor 20 delivers the compressed flow of air to the combustor 30. The combustor 30 mixes the compressed flow of air with a flow of fuel and ignites the mixture. (Although only a single combustor 30 is shown, the gas turbine engine 10 may include any number of combustors 30.) The hot combustion gases are delivered in turn to a turbine 40. The turbine 40 drives the compressor 20 and an external load 50 such as an electrical generator and the like. The gas turbine engine 10 may use other configurations and components herein. The gas turbine engine 10 may use natural gas, various types of syngas, and other fuels.

Figure 2:
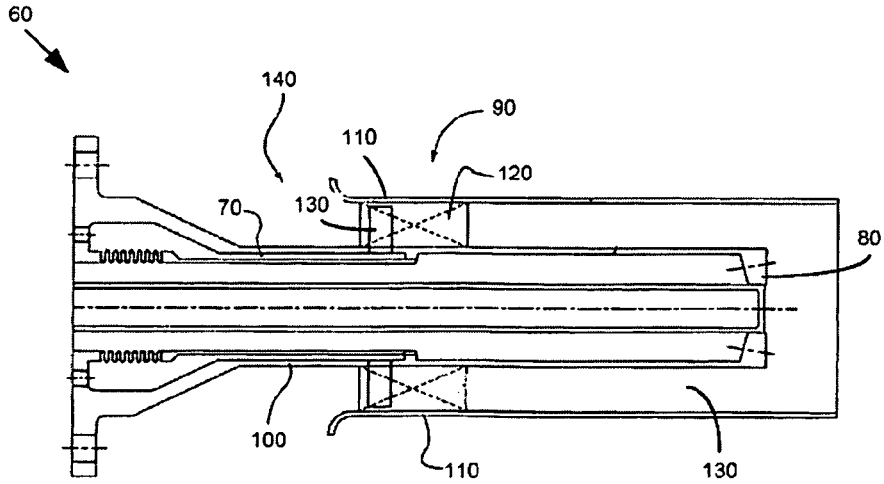
Fig. 2 (PRIOR ART)
FIG. 2 is a schematic view, partly in cross-section, of a conventional swozzle type burner.
Figure 3:
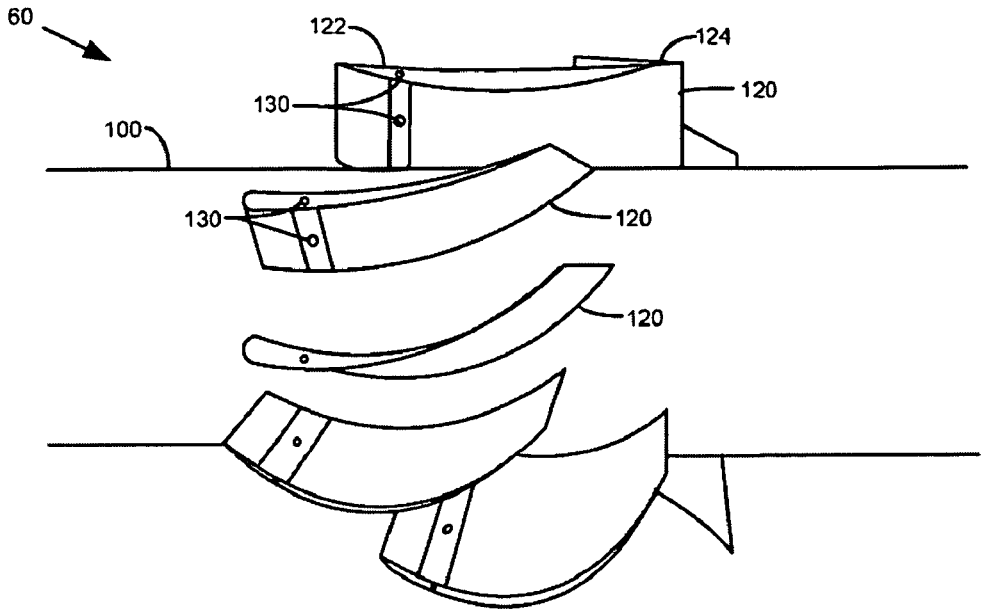
FIG. 3 is a perspective view of the fuel vanes of the swozzle burner of FIG. 2.

FIG. 2 shows a swozzle burner 60 that may be used with the combustor 30 as described above. As is known, the swozzle burner 60 may include a number of annular fuel passages 70. Some of the annular fuel passages 70 may extend to a diffusion tip 80 while others may extend to a swozzle assembly 90. The swozzle assembly 90 may include a center body or a hub 100 and a shroud 110 connected by a series of airfoil shaped fuel vanes 120. Each vane 120 may have an upstream end 122 and a downstream end 124. As is shown in FIGS. 2 and 3, each fuel vane 120 may include one or more fuel injection ports 130. The swozzle assembly 90 also defines an air inlet 140 upstream of the fuel vanes 120. Other configurations of the swozzle burner 60 and the swozzle assembly 90 may be used herein In operation, fuel injected from the fuel injection ports 130 of the fuel vanes 120 thus mixes with the incoming airflow from the air inlet 140. The shape of the fuel vanes 120 imparts swirl to the fuel flows and the air flows so as to promote good mixing in a premix flow. The premix flow is then ignited downstream of the swozzle assembly 90.

Figure 4:
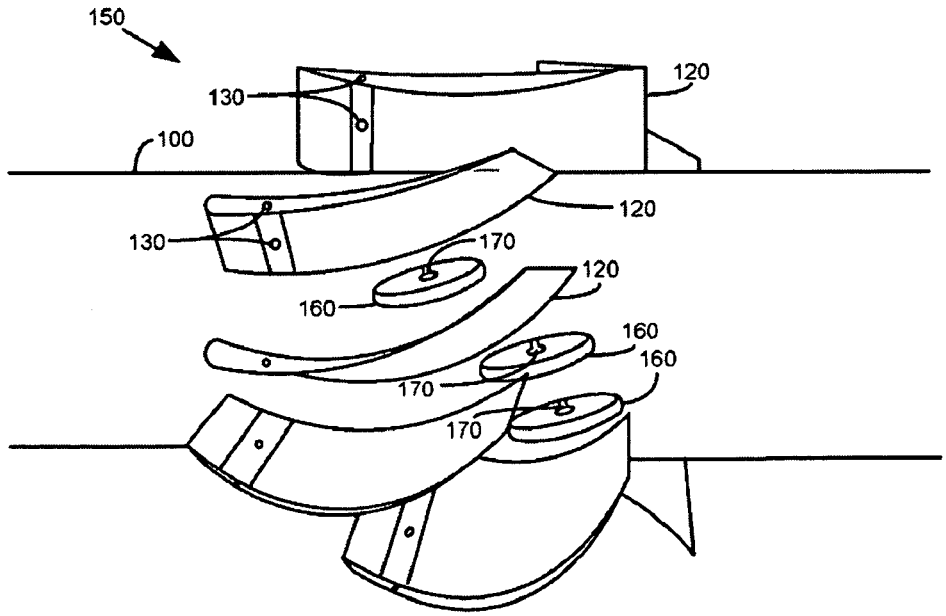
FIG. 4 is a perspective view of the fuel vanes with vanelets in the swozzle burner as is described herein.
Figure 5:
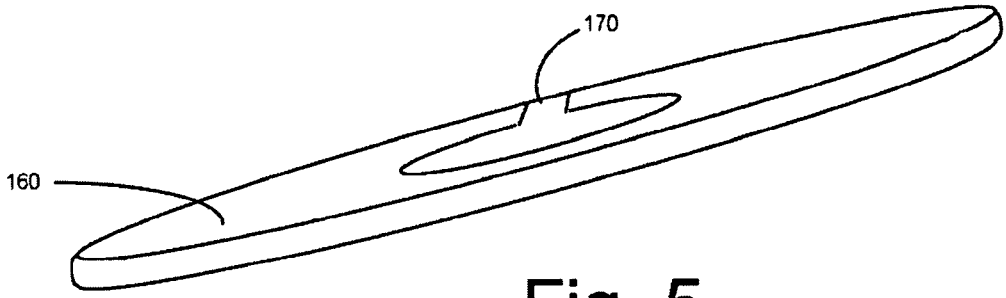
FIG. 5 is a plan view of a vanelet of FIG. 4.

FIGS. 4 and 5 show portions of a swozzle burner 150 as is described herein. The swozzle burner 150 may include the components of the swozzle burner 60 described above. The swozzle burner 150 also includes a number of vanelets 160. The vanelets 160 may be positioned between the fuel vanes 120 that are described above. The vanelets 160 may be positioned about the downstream end 124 of the fuel vanes 120 and may extend for any length towards the upstream end 122 as shown in the two rightmost vanelets of FIG. 4. The vanelets 160 also may be positioned anywhere upstream of the downstream end 124 of the fuel vanes 120 and may extend for any length towards the upstream end 122 as shown by the leftmost vanelet in FIG. 4. The vanelets 160 may have an oval-like shape as is shown or any desired shape or desired size. The vanelets 160 may include one or more fuel injection ports 170 therein. The vanelets 160 also may be used without the fuel injection ports 170. Further, some of the vanelets 160 may have a fuel injection port 170 and others may not. Any number of vanelets 160 may be used. The vanelets 160 also may extend off the hub 100 or come down from the shroud 110 as is described below.

Figure 6:
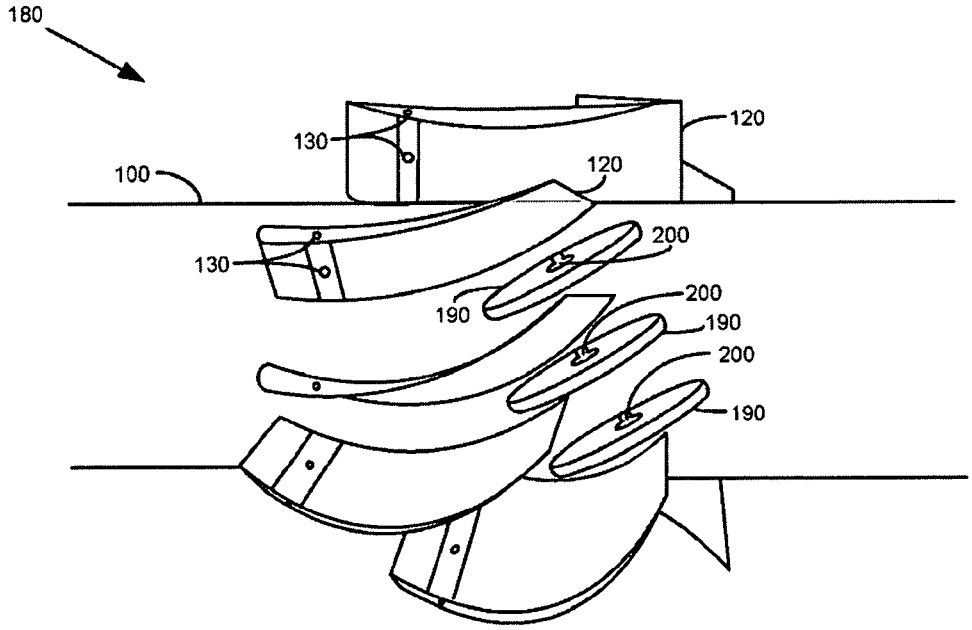
FIG. 6 is an alternative embodiment of the swozzle burner as is described herein with extended vanelets.

FIG. 6 shows an alternative embodiment of a swozzle burner 180. In this embodiment, the swozzle burner 180 may have a number of vanelets 190 that extend at least in part beyond the downstream end 124 of the fuel vanes 120. The vanelets 190 may have an oval-like shape as is shown or any desired shape or desired size. The vanelets 190 also may have a fuel injection port 200 therein. The vanelets 190 also may be used without the fuel injection ports 200. Further, some of the vanelets 190 may have a fuel injection port 200 and others may not. Any number of the vanelets 190 may be used.

Figure 7:
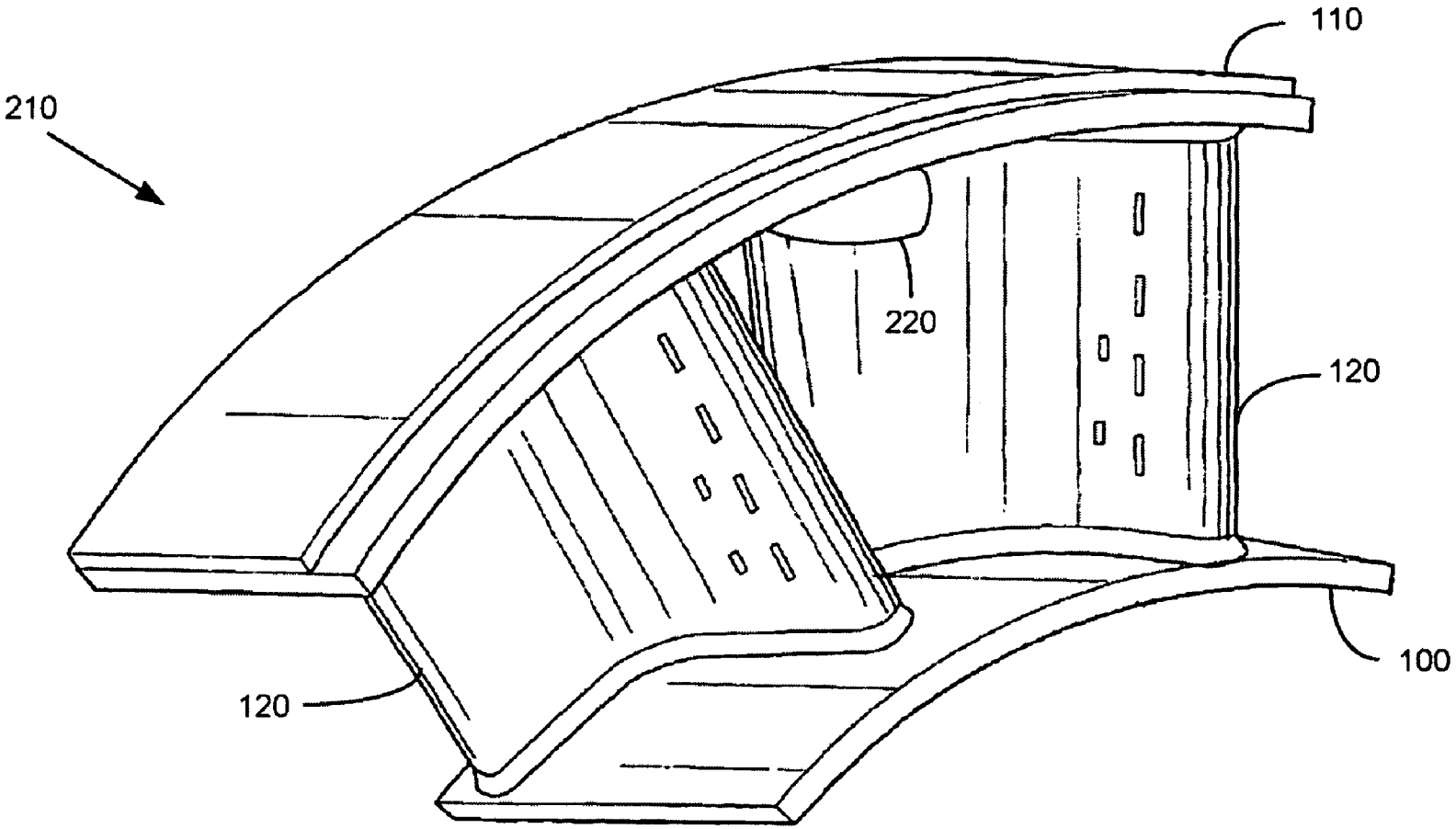
FIG. 7 is an alternative embodiment of the swozzle burner as is described herein with the vanelets positioned on the shroud.

FIG. 7 shows an alternative embodiment of a swozzle burner 210. In this embodiment, the swozzle burner 210 may have a number of vanelets 220 that are positioned about the shroud 110 as opposed to the hub 100. The vanelets 220 likewise may have an oval shape or any desired shape or desired size. The vanelets 220 also may have a fuel injection port therein if desired. Any number of the vanelets 220 may be used. Several of the vanelets 220 may be positioned on the shroud 110 while others may be positioned on the hub 100.

The use of the vanelets 160, 190, 220 between the fuel vanes 120 helps to maintain mixture velocity as the fuel flow extends downstream along each vane 120. Specifically, the velocity of the fuel/air mixture remains high in the turning portion of each of the vanes 120 as the vanes 120 taper towards the downstream end 124. The vanelets 160, 190, 220 thus allow a reduction in the swirl and an increase in axial velocity of the mixture. This maintained, predetermined velocity permits a reduction in the swirl along the main vanes 120 without creating an expansion zone or a low velocity zone adjacent to the main vanes 120 until the flow is further downstream. The vanelets 160, 190, 220 also may provide sequestration by preventing interaction between the fuel injection ports 170 from opposing vanes 120. The flow sequestration also may improve the flame holding margin. The vanelets 160, 190, 220 also may function as a quenching surface.

The use of the vanelets 160, 190, 220 with the fuel injection ports 170, 200 also provides secondary fuel injection points such that the fuel flow from the main fuel injection ports 130 of the fuel vanes 120 may be reduced. The size of the fuel injection ports 130 also may be reduced. Such a reduction of the main flow may improve the flame holding margin.

As described above, higher reactivity fuels, such as high hydrogen syngas, usually are burned in a diffusion mode instead of premixed in the swozzle assembly 90. By providing for a higher axial velocity of the fuel flow, the vanelets 160, 190, 220 may permit premixing of these higher reactivity fuels while maintaining reduced nitrogen oxide ($NO_x$) emissions. The need for a diluent flow also may be reduced. The vanelets 160, 190, 220 thus may improve the fuel holding margins for higher reactivity fuels by allowing a higher axial velocity for a given pressure drop.

The fuel injection ports 170, 200 of the vanelets 160, 190, 220 may be used to inject alternative fuels so as to provide greater fuel flexibility. The fuel injection ports 170, 200 of the vanelets 160, 190, 220 also may be used to inject diluent, inert gases, or other types of fluids.

The use of the fuel injection ports 170, 200 of the vanelets 160, 190, 220 thus permits a reduced fuel flow through the main vanes 120 and/or permits a reduction in the size of the fuel injection ports 130. The fuel injection ports 170, 200 of the vanelets 160, 190, 220 further provide fuel flexibility for fuels outside of the Modified Wobbe index range of the main fuel injector ports 130 by allowing premixing of other fuels so as to keep $NO_x$ emissions low.

It should be apparent that the foregoing relates only to certain embodiments of the present application and that numerous changes and modifications may be made herein by one of ordinary skill in the art without departing from the general spirit and scope of the invention as defined by the following claims and the equivalents thereof.

We claim:

1. A burner for use with a combustor of a gas turbine engine, comprising:
- a center hub;
- a shroud;
- a pair of fuel vanes extending from the center hub to the shroud; and
- a vanelet extending from the center hub and/or the shroud and positioned between the pair of fuel vanes.

2. The burner of claim 1, further comprising a plurality of fuel vanes and a plurality of vanelets with one of the plurality of vanelets positioned between each pair of the plurality of fuel vanes.

3. The burner of claim 1, wherein the vanelet comprises a fuel injection port.

4. The burner of claim 2, wherein one or more of the plurality of vanelets comprise a fuel injection port.

5. The burner of claim 1, wherein each of the pair of fuel vanes comprises an airfoil shape.

6. The burner of claim 1, wherein each of the pair of fuel vanes comprises an upstream end and a downstream end and wherein the vanelet is positioned about the downstream end.

7. The burner of claim 1, wherein each of the pair of fuel vanes comprises an upstream end and a downstream end and wherein the vanelet is positioned at least in part beyond the downstream end.

8. The burner of claim 1, wherein the vanelet comprises a quenching surface.

9. The burner of claim 1, wherein the vanelet comprises a sequestering surface.

10. A method of mixing fuel and air in a combustor burner of a gas turbine, comprising:
- flowing the air into a swozzle assembly;
- flowing the fuel through a plurality of fuel vanes in the swozzle assembly;
- imparting swirl to the flow of air and the flow of fuel to create a premixed flow; and
- positioning a vanelet between a pair of the plurality of fuel vanes so as to at least maintain the premixed flow at a predetermined velocity as the premixed flow leaves the plurality of fuel nozzles.

11. The method of claim 10, wherein flowing the fuel comprises flowing a syngas.

12. The method of claim 10, wherein flowing the fuel comprises flowing natural gas.

13. The method of claim 10, further comprising flowing a secondary flow of fuel through the vanelet.

14. The method of claim 13, wherein flowing a secondary flow of fuel comprises flowing a diluent or an inert gas.

15. The method of claim 10, wherein positioning a vanelet between a pair of the plurality of fuel vanes comprises positioning a plurality of vanelets.

16. A swozzle assembly for use with a combustor of a gas turbine engine, comprising:

a center hub;

a shroud;

a plurality of swozzle vanes extending from the center hub to the shroud; and a plurality of vanelets extending from the center hub and/or the shroud and with one of the plurality of vanelets positioned between each pair of the plurality of swozzle vanes.

17. The swozzle assembly of claim 16, wherein one or more of the plurality of vanelets comprise a fuel injection port.

18. The swozzle assembly of claim 16, wherein the plurality of swozzle vanes comprises an upstream end and a downstream end and wherein the plurality of vanelets is positioned about the downstream end.

19. The swozzle assembly of claim 16, wherein the plurality of swozzle vanes comprises an upstream end and a downstream end and wherein the plurality of vanelets is positioned at least in part beyond the downstream end.

20. The swozzle assembly of claim 16, wherein the plurality of vanelets comprises a quenching surface.

* * * * *